US005127117A

United States Patent [19]

Bridges

[11] Patent Number: 5,127,117

[45] Date of Patent: Jul. 7, 1992

[54] PILLOW CONSTRUCTION

[76] Inventor: Robert L. Bridges, 301 Avenida Flores, Pacheco, Calif. 94553

[21] Appl. No.: 680,259

[22] Filed: Apr. 4, 1991

[51] Int. Cl.[5] ..... A47C 20/02

[52] U.S. Cl. ..... 5/636; 5/490; 5/638

[58] Field of Search ..... 5/434, 436, 442, 490, 5/435

[56] References Cited

U.S. PATENT DOCUMENTS

| | | | |
|---|---|---|---|
| 1,447,288 | 3/1923 | Emmerich | 5/442 |
| 1,677,743 | 7/1928 | Berton | 5/442 |
| 2,293,530 | 8/1942 | Beehler | 5/442 |
| 2,412,769 | 12/1946 | Easterbrooks | 5/434 |
| 2,413,828 | 1/1947 | Hirsh et al. | 5/434 |
| 3,121,886 | 2/1964 | Seymour | 5/442 |
| 3,148,389 | 9/1964 | Lustig | 5/434 |
| 3,538,508 | 11/1970 | Young | 5/434 |
| 4,144,603 | 3/1979 | Schaechter | 5/490 |
| 4,420,847 | 12/1983 | Smith | 5/490 |
| 5,016,303 | 5/1991 | Tanaka et al. | 5/434 |

FOREIGN PATENT DOCUMENTS

| | | | |
|---|---|---|---|
| 419527 | 1/1911 | France | 5/434 |

*Primary Examiner*—Renee S. Luebke
*Assistant Examiner*—Michael J. Milano
*Attorney, Agent, or Firm*—Harold D. Messner

[57] ABSTRACT

In accordance with the invention, a pouch pillow construction is described which comprises, a base pillow including a cover and casing, and an overlying pillow including a cover and casing. The base and overlying pillows are sewn along three adjacent sides and open on a fourth side to form a pouch into which a person's head can be conveniently inserted to gain warmth and mask light, both of which surprisingly combine permit a person to sleep deeply. But the person head can rest atop both the base and overlaying pillows without using the pouch if the restee so chooses. The casing of the overlying pillow can also include a layer of light impregnable material to mask light, such material along with the casing being light weight to prevent heat loss without using high weight that could disturb the sleeping process. In that regard, the ratio of the thicknesses of the base pillow to the overlaying material is in the range of 2 to 6 wherein the thickness of the overlaying pillow ranges from ¾ to 1½ inches at the center thereof.

16 Claims, 3 Drawing Sheets

PILLOW CONSTRUCTION

SCOPE OF THE INVENTION

This invention relates to a pillow to aid in resting and more particularly to novel pillow construction in which the person's head can rest either upon or within the latter to give comfort and warmth. In one aspect, the invention includes base and overlaying pillows secured together along side and rear edges but upon along a front edge to define a pouch into which a person's head can be conveniently inserted to gain warmth and mask light, both of which surprisingly combine permit a person to sleep deeply. In another aspect, the person head can rest atop both the base and overlaying pillows.

BACKGROUND OF THE INVENTION

Heretofore, caps, hats and the like have been used to reduce lose of heat from a person's head during sleeping. Frequently, such head covers become dislodged during the sleeping process causing—more often than not—the person to become awakened due to the lose of heat from the head.

U.S. Pat. No. 2,412,769 for "Pillow Head Covers", H. E. Easterbrook shows a head cover attached to a pillow case foldable along a single rear edge and releasably attached along side edges by tab means. But since the tabs use buttons insertable through openings in the tabs, the cover often become dislodged and if not dislodged, permits heat lose between the unseamed sides of the cover. In addition, only a single pillow can be inserted into the cover to provide the desired comfort.

SUMMARY OF THE INVENTION

In accordance with the invention, a pouch pillow construction is described which comprises, a base pillow including a cover and casing, and an overlying pillow including a cover and casing. The case and overlying pillows are sewn along three adjacent sides and open on a fourth side to form a pouch into which a person's head can be conveniently inserted to gain warmth and mask light, both of which surprisingly combine permit a person to sleep deeply. But the person head can rest atop both the base and overlaying pillows without using the pouch if the restee so chooses. The casing of the overlying pillow can also include a layer of light-impregnable material to mask light, such material along with the casing being light weight to prevent heat lose without using high weight that could disturb the sleeping process. In that regard, the ratio of the thicknesses of the base pillow to the overlaying material is in the range of 3 to 8 wherein the thickness of the overlaying pillow ranges from ¾ to 1½ inches at the center thereof.

DETAILED DESCRIPTION OF AN EMBODIMENT OF THE INVENTION

Figure 1:
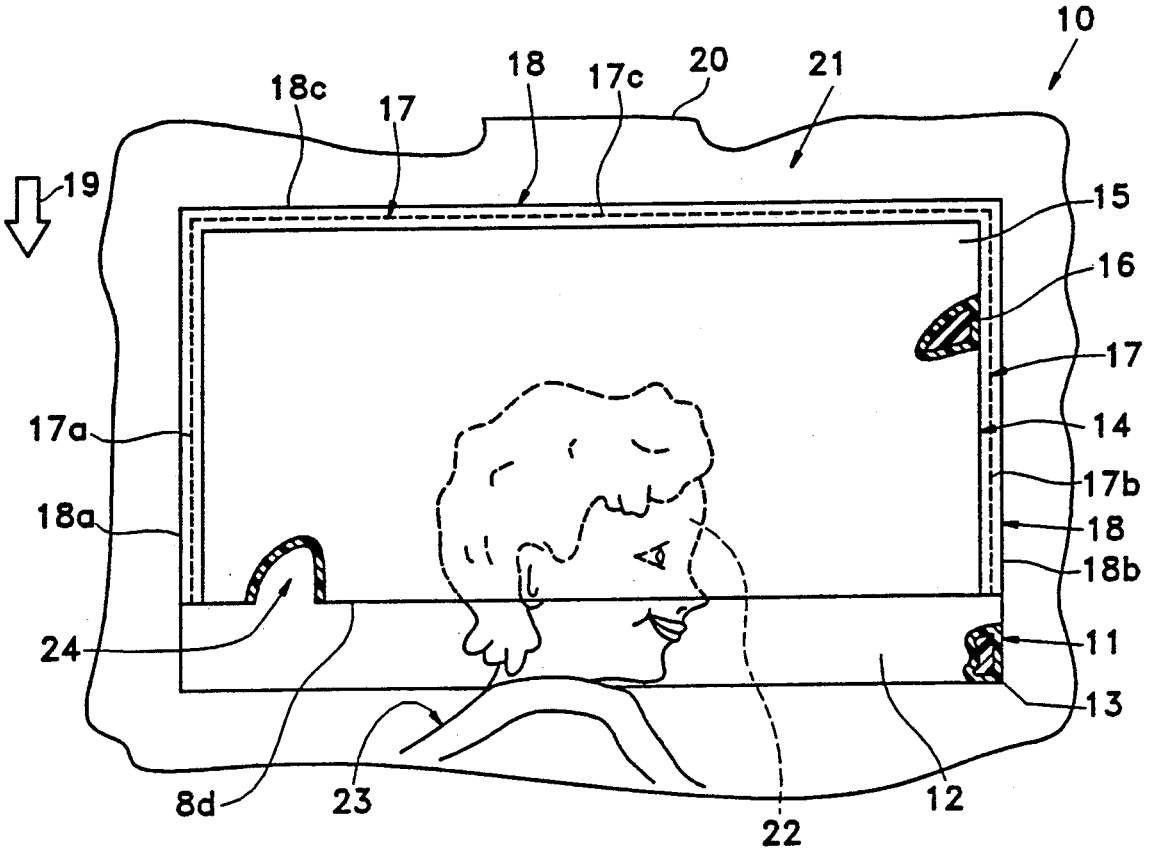
FIG. 1 is top elevational view of the pouch pillow of the invention—partially cutaway—in which a person's head is inserted within the pillow of the invention.

In accordance with the invention in FIGS. 1-4, a novel pouch pillow construction 10 is described. It comprises a base pillow 11 of rectangular cross section including a cover 12 and comfort-providing casing 13, and an overlying pillow 14 also of rectangular cross section. The overlying pillow 14 also including a cover 15 and casing 16. The base pillow 11 and the overlying pillow 14 are sewn together by a series of seams generally indicated at 17 adjacent to three adjacent edges of the pillows 11, 14. The edges are generally indicated at 18. The seams are positioned as follows: a pair of side seams **17*a*, 17*b* are adjacent to edges 18*a*, 18*b*, respectively; while back seam 17*c* is adjacent to back edge 18*c*. A fourth edge 18*c* of the pillows 11, 14 opposite to rear edge 18*c* is open in a direction 19 away from head 20 to bed 21 to permit upper head 22 of a person 23 to be supported therein. That is, such fourth edge 18*c* plus the closed edges 18*a*–18*c* via seams 17*a*–17*c* are constructed so as to form a pouch 24 into which the person's head 22 can be conveniently inserted. Because of the shape of the pouch 24 and its construction, as described below, the head 22 has found to gain warmth and mask light in such position, both of which surprisingly combine permit the person 23** to sleep deeply.

Figure 2:
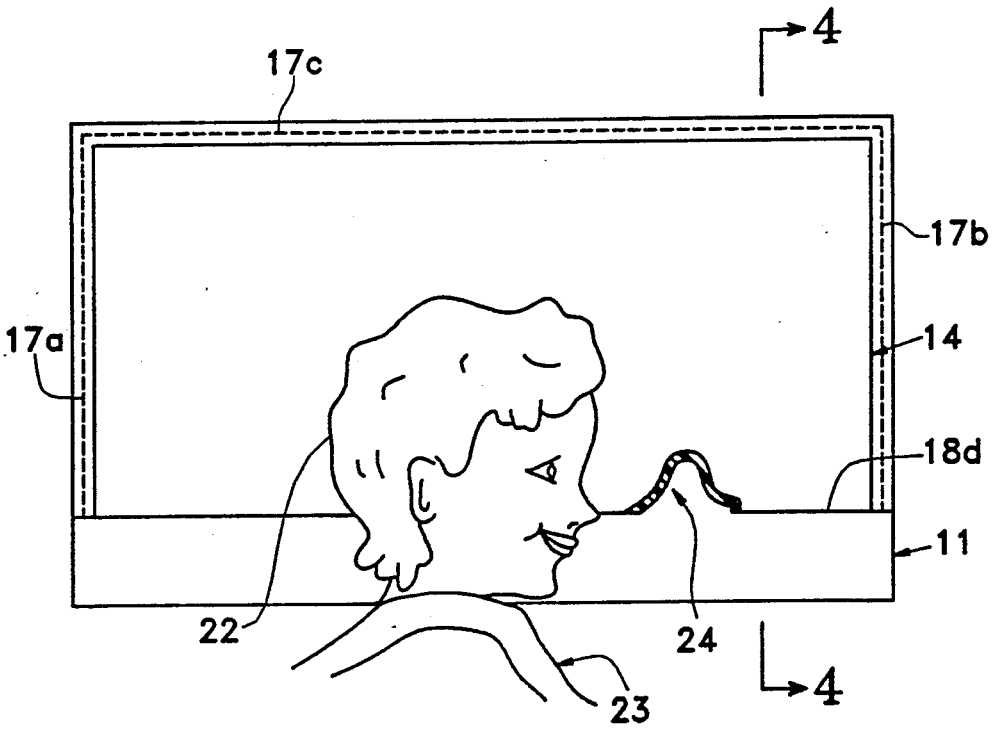
FIG. 2 is top elevational view of the pouch pillow of the invention in which a person's head is removed from the pillow of the invention.

Note in FIG. 2 that the upper head 22 of the person 23 can rest atop both the base pillow 11 and the overlaying pillow 14. In this embodiment, the person 23 does not use the pouch 24 via open edge **18*d* instead relies upon both base pillow 11 and overlaying pillow to provide comfort. The series of seams 17*a*–17*c* keep the pillows 11, 14** unitized, however.

Figure 3:
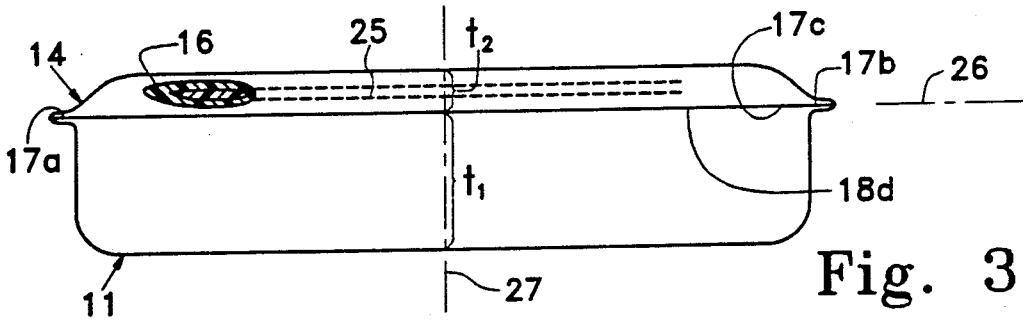
FIG. 3 is front elevational view of the pouch pillow of the invention.

FIG. 3 shows the horizontal positioning of the side seems **17*a*, 17*b* along with back seam 17*c* and open edge 18*c*. That is, they are horizontally coincident with a horizontal working plane 26**.

Figure 4:
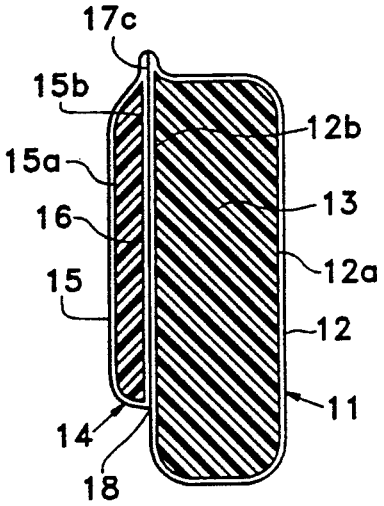
FIG. 4 is a section taken along line 4—4 of FIG. 2.

In FIG. 4, the construction of the covers 12, 15 and casings 13, 16 of the base pillows 11 and overlying pillow 14, respectively, are shown in detail.

As shown, the covers 12, 15 of pillows 11, 14, respectively, include upper and lower panels **12*a*, 12*b* and 15*a*, 15*b*, respectively. Each cover 12, 15 is closed along all four edges by seams (not shown) to enclose each casing 13, 16 completely before the series of seams 17*a*–17*c* are applied. While the covers 12, 15 can be of identical material such as cotton or man-made materials conventional in the art, the casing 13, 16 can be of conventional ticking formed of plastic as shown or of feathers but differ from each other in that casing 16 of the overlaying pillow 15 includes a layer 25 (see FIG. 3) formed of a light-impregnable material such as a 50% polyester/50% cotton blend such "Sleepsafe Blackout" sold by Hancock Fabrics, Vallejo, Calif. 94590. Its purpose: to mask light. The layer 25 is sandwiched between and within the casing 16 to mask light but is light enough so as not to disturb the sleeping process. Likewise, while the casing 16** is heavy enough to retain heat, it is also light enough so as not to disturb the sleeping process.

Note also that the casing 13 is much ticker than casing 16, being a value that is conventional in the art, say in a range of 4 to 6 inches. While in practice, the thickness of the overlaying pillow 14 is in a range of ¾ to 1½ inches measured along vertical plane 27 (see FIG. 3) bisecting both pillows 11 and 14 midway between edges 17*a*, 17*b*. In that regard, the ratio of the maximum thickness t1 (along vertical plane 27) of the base pillow 11 to the thickness 12 of the overlaying pillow 14 is in the range of 3 to 8 wherein the thickness 12 of the overlaying pillow 14 ranges from ¾ to 1½ inches.

Figure 5:
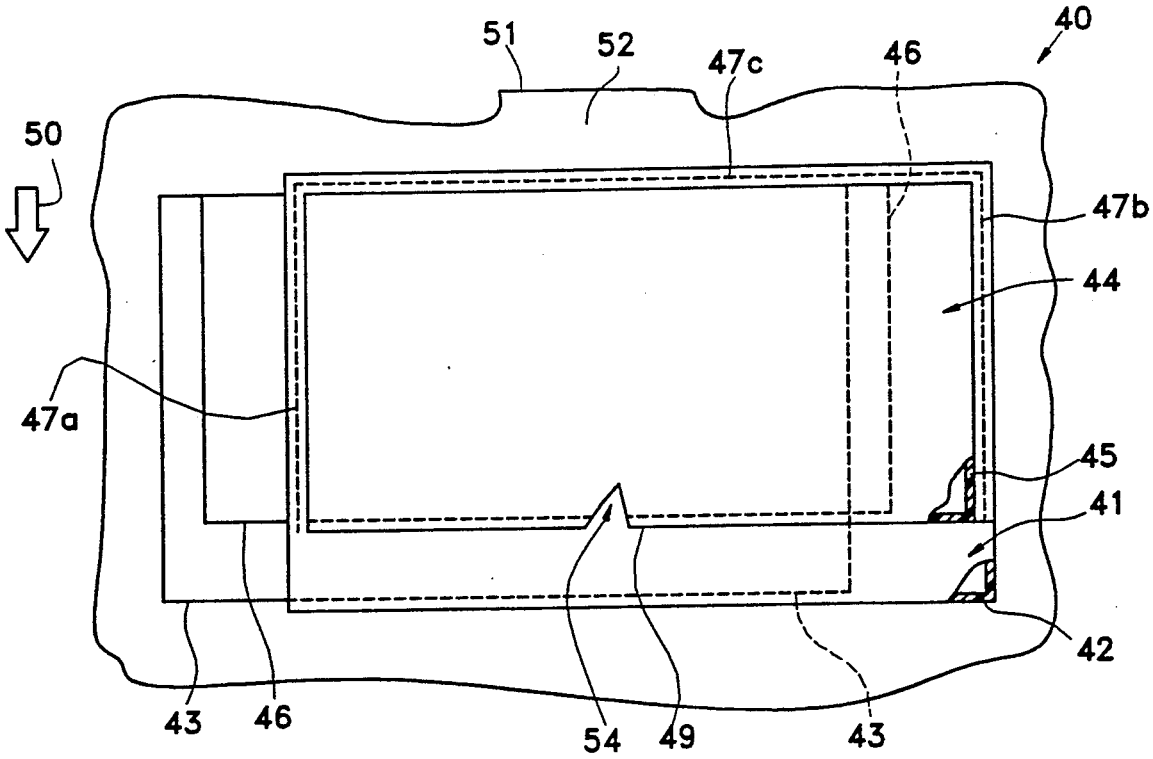
FIG. 5 is top elevational view of a modification of the pouch pillow of the invention.
Figure 6:
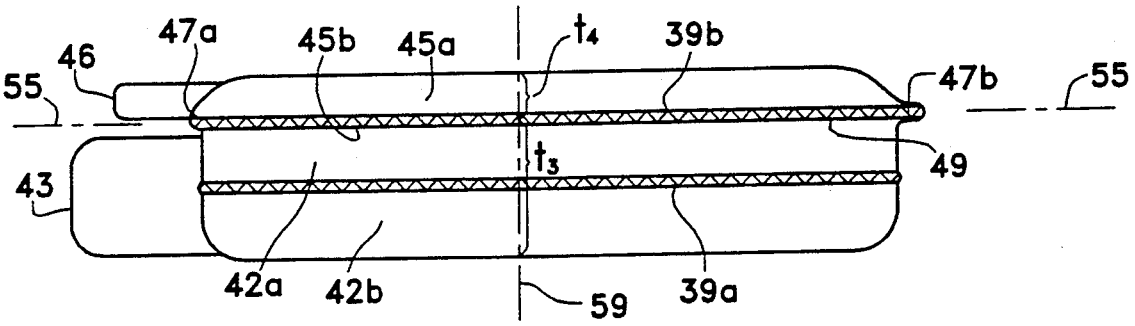
FIG. 6 is front elevational view of the modification of the pouch pillow of FIG. 5.
Figure 7:
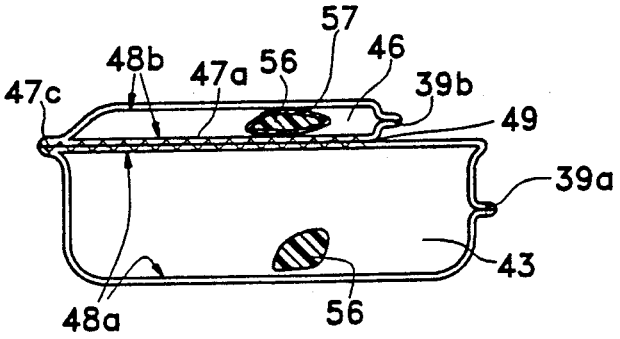
FIG. 7 is end elevational view of a modification of the pouch pillow of FIG. 5.

FIGS. 5–7 shows a modification of the pillow construction 10 of FIGS. 1–4.

As shown, in FIGS. 5–7, a second novel pouch pillow construction 40 is described. It comprises a base pillow assembly 41 of rectangular cross section including a cover 42 and insertable casing 43, and an overlying pillow assembly 44 also of rectangular cross section. The overlying pillow assembly 44 also including a cover 45 and a second insertable casing 46. The covers 42 and 45 of the base pillow 41 and the overlying pillow 44 are each akin to conventional pillowcases and are formed as follows:

First, the base cover 42 is cut from a conventional bolt of cloth and then the cut material is folded over and seamed along a transverse seam 39*a* (see FIG. 6) to form upper and lower panels 44*a*, 42*b*. Likewise the overlaying cover 45 is folded over and seamed along seam 39*b* to form another upper and lower panel pair 45*a*, 45*b*. Then the above intermediate subassemblies are sewn together along three contiguous seams, viz., along side seam 47*a* between adjacently positioned upper panel 42*a* of the base cover 42 and lower panel 45*b* of overlying cover 45 (see FIG. 7); side seam 47*b*; and back seam 47*c* wherein the previously formed seams 39*a*, 39*b* are contiguously positioned relative to each other, viz., above or below each other as shown in FIG. 6. Note the open sides of the final assembly: along stacked edges 48*a*, 48*b* that are opposite seam 47*b* (see FIG. 7) to receive insertable casing 43, 46, respectively; as well as along side 49 opposite to back seam 47*c* (see FIGS. 5–7) wherein the person'head (not shown) can be received. Note that the side 49 is also normal to stacked edges 48*a*, 48*b*. That is, the cover 45 of the overlaying pillow 44 is open in a direction 50 away from head 51 to bed 52 to permit a person's head (not shown but illustrated in FIG. 1) to be supported therein. That is, a pouch 54 is formed as shown in FIG. 5 closed on three sides by the seams 47*a*–47*c* yet is shaped to provide room for person's head conveniently inserted via opening 49. Because of the shape of the pouch 54 and its construction, as described above, the head has found to gain warmth and mask light in such position, both of which surprisingly combine permit the person to sleep deeply.

Note that resulting pillow construction 40 can also be described annotated to ply type of each seam 47*a*–47*c*. In this regard, note that the long back seam 47*c* projects through four plies of material constituting both upper and lower panels 42*a*, 42*b*, 45*a*, 45*b*, of the covers 42, 45. The short side seam 47*b* also projecting through four plies of the material comprising both upper and lower panels 42*a*, 42*b*, 45*a*, 45*b* of the covers 42, 45. The second short side seam 47*a* is opposite to the first side seam 47*b* and only projects through two plies of the covers 42, 45 wherein one ply is the upper panel 45*a* of the cover 45 and the other ply is the lower panel 42*b* of the cover 42.

Note that the person's head can rest atop both the base pillow 41 and the overlaying pillow 44. In such an embodiment, the person does not use the pouch 54 instead relies upon both the base pillow 41 and overlaying pillow 44 to provide comfort. Sewn seams 47*a*–47*c* keep the pillows 41, 44 unitized.

FIG. 6 shows the horizontal positioning of the side seams 47*a*, 47*b* along with back seam 47*c* and open side 49. That is, they are horizontally coincident with a horizontal working plane 55.

The construction of the covers 42, 45 and casings 43, 46 of the base pillow 41 and overlying pillow 44, respectively, are conventional. The covers 42, 45 can be of cotton or man-made materials conventional in the art but must be shaped as described above. The insertable casings 43, 46 may differ from each other in that casing 46 of the overlaying pillow 45 can include layer 56 of a light-impregnable material as previously described sandwiched within ticking 57 (see FIG. 7). Its purpose: to mask light. The insertable casing 43 of the base pillow 41 can include a conventional ticking 58 of plastic, feathers or the like and is of a conventional thickness that is used in the pillow making art, say from 4 to 6 inches. But the thickness of the overlaying pillow 14 is much thinner say from ¾ to 1 ½ inches measured along vertical plane 59 bisecting both pillows 41 and 44 midway between sides 47*a*, 47*b*. In that regard, the ratio of the maximum thickness t3 (along vertical plane 59 to FIG. 6) of the base pillow 41 to the thickness 14 of the overlaying pillow 44 is in the range of 3 to 8 wherein the thickness t4 of the overlaying pillow 44 ranges from ¾ to 1½ inches.

Figure 8:
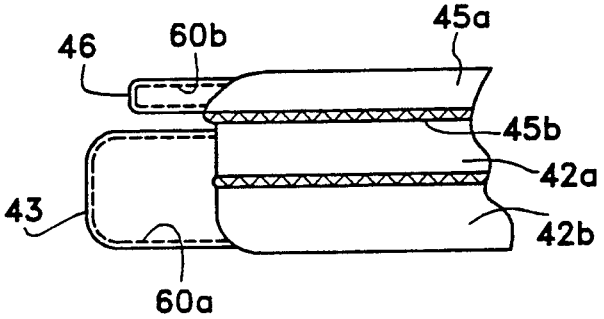
FIG. 8 is a detail of modified insertable casings of the invention of FIGS. 5-7 showing separate covers.

Note also that the insertable casing 43, 46 can also be modified. As shown in FIG. 8, the casing 43 slidable within separate fold panels 42*a*, 42*b* includes a separate cover 60*a* of cotton, plastic or the like. Likewise the casing 46 that can be slipped within separate fold panels 45*a*, 45*b* includes a separate cover 60*b* of cotton, plastic or the like.

What is claimed is:

1. An article of manufacture comprising a base pillow including a cover and casing, and an overlying pillow including a cover and casing, said base and overlying pillows having maximum thicknesses t1 and t2, respectively, said base and overlying pillows together defining three adjacent edges sewn by a series of seams and a fourth long edge open to the exterior, said three adjacent edges being connected by said series of seams so as to form a pouch into which a person's head can be conveniently inserted through said fourth open end to gain warmth and mask light but rest comfortably on said base pillow, said thicknesses t1 and t2 defining a ratio R wherein $r = t1/t2$ is an range of 3 to 8 wherein a person is surprisingly able to sleep deeply irrespective of colder temperature.

2. The article of manufacture of claim 1 in which said casing of said overlying pillow includes a layer of light-impregnable material masking light to a substantial degree.

3. The article of manufacture of claim 1 in which said base and overlying pillows are each rectangularly shaped and wherein covers therefor each includes upper and lower panels.

4. The article of manufacture of claim 3 in which said upper and lower panels of said base and overlying pillows are each closed along all four sides about said casing thereof using at least in part said series of seams forming said pouch into which said person's head is received.

5. The article of manufacture of claim 3 in which said upper and lower panels of each base and overlying pillow are each closed along three sides and open along a fourth side for receiving said casing of said base or said overlying pillows, said openings of said covers being positioned in stack manner—one above the other—at substantially right angles to said open fourth edges of said pouch into which said person's head is inserted.

6. The article of manufacture of claim 5 in which said casings of said base and overlying pillows each includes a separate cover formed about ticking means.

7. The article of manufacture of claim 5 in which said seams for providing closure for said pouch includes a long rear seam projecting through four plies of material constituting said upper and lower panels of said covers, a first short side seam positioned opposite to said casing openings projecting also through four plies of said upper and lower panels, and a second short side seam opposite to said first side seam projecting through two plies of said covers wherein one ply is an upper panel of said cover of said base pillow and one ply is a lower panel of said cover of said overlying pillow.

8. The article of manufacture of claim 1 in which T2 defining the thickness of said overlaying pillow ranges from $\frac{3}{4}$ to $1\frac{1}{2}$ inches at the maximum extent thereof.

9. A pillow construction which provides the restee with surprising comfort and warmth comprising a base pillow and an overlying pillow, said base and overlying pillows having maximum thicknesses t1 and t2, respectively and together defining three adjacent edges sewn by a series of seams and a fourth long edge open to the exterior, said three adjacent edges being connected by said series of seams so as to form a pouch into which a person's head can be conveniently inserted through said fourth open edge to gain warmth and mask light but rest comfortably on said base pillow, said thicknesses t1 and t2 defining a ratio R wherein $$r = t1/t2 \text{ is an range of 3 to 8}$$

wherein a person is surprisingly able to sleep deeply irrespective of colder temperature.

10. The pillow construction of claim 9 in which said overlying pillow includes a layer of light impregnable material which masks out light to a substantial degree.

11. The pillow construction of claim 9 in which said base and overlying pillows are each rectangularly shaped and each includes a cover having upper and lower panels and a comfort-providing casing.

12. The pillow construction of claim 11 in which upper and lower panels of said base and overlying pillows are each closed along all four sides about said casing thereof using at least in part said series of seams forming said pouch into which said person's head is received.

13. The pillow construction of claim 11 in which said upper and lower panels of each base and overlying pillow are each closed along three sides and open along a fourth side for receiving said casing of said base or said overlying pillows, said openings of said covers being positioned in stacked manner—one above the other—at substantially right angles to said open fourth edge of said pouch into which said person's head is inserted.

14. The pillow construction of claim 13 in which said casings of said base and overlying pillows each includes a separate cover formed about ticking means.

15. The pillow construction of claim 13 in which said seams for providing closure for said pouch includes a long rear seam projecting through four plies of material constituting said upper and lower panels of said covers, a first short side seam positioned opposite to said casing openings projecting also through four plies of said upper and lower panels, and a second short side seam opposite to said first side seam projecting through two plies of said covers wherein one ply is an upper panel of said cover of said base pillow and one ply is a lower panel of said cover of said overlying pillow.

16. The pillow construction of claim 9 in which T2 defining the thickness of said overlaying pillow ranges from $\frac{3}{4}$ to $1\frac{1}{2}$ inches at the maximum extent thereof.

* * * * *